US005557891A

United States Patent [19]

Albracht

[11] Patent Number: 5,557,891

[45] Date of Patent: Sep. 24, 1996

[54] GUTTER PROTECTION SYSTEM

[76] Inventor: Gregory P. Albracht, 9623 Burdette, Omaha, Nebr. 68134

[21] Appl. No.: 414,271

[22] Filed: Mar. 31, 1995

[51] Int. Cl.[6] ..... E04D 13/076

[52] U.S. Cl. ..... 52/12; 52/11

[58] Field of Search ..... 52/12, 11

[56] References Cited

U.S. PATENT DOCUMENTS

| | | | |
|---|---|---|---|
| 603,611 | 5/1898 | Nye . | |
| 2,847,949 | 4/1954 | Pond . | |
| 2,873,700 | 2/1959 | Heier | 52/12 |
| 4,286,418 | 9/1981 | Snyder | 52/11 |
| 4,404,775 | 9/1983 | Demartini . | |
| 4,455,791 | 6/1984 | Elko et al. . | |
| 4,493,588 | 1/1985 | Duffy . | |
| 4,497,146 | 2/1985 | Demartini . | |
| 4,551,956 | 11/1985 | Axford . | |
| 4,571,896 | 2/1986 | Condie . | |
| 4,592,174 | 6/1986 | Hileman | 52/12 |
| 4,631,875 | 12/1986 | Olson . | |
| 4,750,300 | 6/1988 | Winger, Jr. | 52/12 |
| 4,757,649 | 7/1988 | Vahldieck . | |
| 4,796,390 | 1/1989 | Demartini . | |
| 4,858,396 | 8/1989 | Rose et al. . | |
| 4,866,890 | 9/1989 | Otto . | |
| 4,876,827 | 10/1989 | Williams . | |
| 4,937,986 | 7/1990 | Way, Jr. . | |
| 5,016,404 | 5/1991 | Briggs . | |
| 5,181,350 | 1/1993 | Meckstroth . | |
| 5,189,849 | 3/1993 | Collins . | |
| 5,216,851 | 6/1993 | Kuhns . | |

*Primary Examiner*—Carl D. Friedman
*Assistant Examiner*—Christopher Todd Kent
*Attorney, Agent, or Firm*—James D. Welch

[57] ABSTRACT

A gutter protection system for use in preventing debris, which flows off of a sloped building roof along with rain water, from entering a gutter system affixed to lower edges of the sloped building roof, is disclosed. The present invention effects at least two reversals of direction of flowing rain water entering thereonto prior to directing it into an underlying gutter system to which it is affixed. The present invention system also includes end caps, a diverter for use at converging roof locations, and optional mounting brackets. The present invention system is designed to be easy to install.

22 Claims, 2 Drawing Sheets

GUTTER PROTECTION SYSTEM

TECHNICAL FIELD

The present invention relates to gutter systems which collect rain water at the lower edges of sloping building roofs. More particularly the present invention relates to an easy to install gutter protection system which prevents the accumulation of debris in gutter systems during use while allowing water to enter thereto.

BACKGROUND

The use of gutter systems at the lower edges of sloping building roofs to accumulate and direct rain water running-off thereof into downspouts for disposal at intended locations, is known. A problem associated with typical gutter systems during use thereof, however, is that they accumulate debris therein, such as leaves and twigs etc., and become clogged. This can occur as typical gutter systems are open at their upper ends. Clogged gutter systems can overflow and in addition to the nuisance created by the failure of said clogged gutter systems to direct water to intended downspouts for disposal at an intended location, can cause water to come into contact fascia and soffits etc. of the buildings to which they are applied. Constant contact with said water can cause damage to said fascia and soffits etc. In severe cases such, as during freezing weather, clogged gutters can develop ice damns, leading to the presence of sufficient weight in said gutter systems so as to actually dislodge them from said associated building. In even minor cases of clogging users must face the inconvenience of having to clean accumulated debris from the said gutter systems.

Inventors have noted the identified problem and responded with numerous systems which to lesser or greater degrees serve to overcome the identified problems. A very early, (1898), Patent, U.S. Pat. No. 603,611 to Nye, for instance describes, in the language of Nye, "an eves hanging trough having its inner wall carried upward above said trough, thence outward over said trough, and backward to the line of attachment to the roof, all in gentle curves . . . ". The Nye system operates by, via capillary action, directing water which runs off the roof of a building to which it is attached onto the portion of the inner wall thereof which is carried outward over the trough thereof and then into said trough, while simultaneously sweeping leaves and other debris off the system, and thereby preventing them from entering said trough. The Nye system is best visualized as comprising a backward "S" shape in side cross section, the upper edge of which is mounted to the eves of a building to which said Nye system is affixed. Another and more recent (1985) U.S. Pat. No. 4,493,588 to Duffy describes a system essentially similar to the Nye system, in which "[T] the curved portion overhangs the trough and a generally vertical screen extends between the trough and the curved portion . . . ". That is, a screen is present to further prevent leaves, twigs and other debris from entering the trough thereof. The upper edge of the Duffy system mounts under shingles on a roof of a building to which said system is affixed. Another more recent (1988) variation of a gutter system which provides benefits similar to those provided by the Nye invention is described in U.S. Pat. No. 4,757,649 to Vahldieck. The Vahldieck invention system comprises "a continuous double-curved convolute curve, generated on a first and second radius, which extends from the back wall, down short of the inside wall of the trough, and inward over the trough". The Vahldieck system is best visualized as being essentially of a squared "C" shape in side cross section, with the edge of the lower extent of said squared "C" shape being bent upward to form said trough, and with the with the upper extent of said squared "C" shape being curved downward in two stages, the second stage of which is defined by a tighter radius of curvature than in the first. In use, water running-off a roof of a building to which the Vahldieck system has been affixed follows, by capillary action, the double curved upper extent of said squared "C" shape and falls into the formed trough. Again, leaves and other debris are directed to locations other than into said trough. A 1989 Patent to Rose et al., U.S. Pat. No. 4,858,396 provides yet another variation on the same general theme "wherein a substantially flat extension which passes beneath the eves terminates in a free edge adjacent a narrow slot in an apex portion of an extended synthetic polymeric tube".

The Patents surveyed to this point serve to provide systems which are particularly applicable to new construction. That is, the Nye, Duffy, Vahldieck and Rose et al. systems provide gutters as a part thereof. Said systems are also applicable as replacements for existing gutter systems, but, said systems are not particularly relevant for retro-fit application to existing gutter systems. Inventors have however, during the 1980's and on into the 1990's, also provided numerous systems applicable for retro-fit to existing gutter systems. For instance, U.S. Pat. Nos. 4,404,775, 4,497,146 and 4,796,390 to Demartini describe systems " . . . which comprise a deflector having a sloped portion, the top edge region of which is adapted for juxtaposition to the roof shingles, and the bottom edge region of which is arcuate through a large radius cross-section. In such embodiments, the farthest outward extension is outside the outermost edge of the associated rain gutter and the lower edge is positioned between the edges of the rain gutter. Embodiments include means for attenuating the force of water and reducing the localized concentrating of water flowing thereover, such as longitudinal ridges and/or means for improving the surface wettability". The system can be visualized as essentially being "hook-shaped", (in side cross-section), in which, during use, the tip of the "hook" is oriented so as to face downward between the edges of an associated gutter system, and the shaft of said "hook" is positioned beneath shingles on the lower edge of the roof of a building to which the system is applied. The Demartini Patents also describe numerous mounting means for use in mounting the described system to existing gutter systems. Another Patent, U.S. Pat. No. 4,455,791 to Elko et al., provides another system for similar use in retro-fit to existing gutter systems. "A protective structure for a gutter includes an elongated, impervious sheet wide enough to extend across at least about 90% of the width of the gutter and up under a lower edge of roofing material. The outer edge of the cover curls downwardly and the water follows the curvature by surface tension to cascade into the gutter. The cover may be held in place by straps that extend transversley across it and have one end engaged under the inwardly turned lip of the gutter and the other end engaged under roofing material". Alternatively clips can also be used for mounting the cover. Another Patent which describes a system for use in retro-fit to existing gutter systems is U.S. Pat. No. 5,016,404 to Briggs. This system provides that "[A] a sheet layer has an edge beneath the shingles and curves in front of and below the fascia above the gutter mouth forming a relatively small entrance region with the gutter. The apex of the curve extends beyond the gutter so that debris carried by water run off falls to the ground while the run off flows around the layer into the gutter". U.S. Pat. No. 5,189,849 to Collins describes a two piece roof rain gutter debris shield/run-off water control system. In the words of Collins, ". . . a roof slope adaptor and its alternate means accommodate every and all roof slope/gutter juxtaposition, thereby eliminating traditional installation problems, a support stabilizer functions to provide stability and rigidity, while preserving the integrity of critical embodiment dimensions, a slope adaptor affixation clip means provides a plurality of attachment means". In essence, a gutter shield embodiment is attached to and above a gutter by means of a support stabilizer, and provides a horizontally oriented capillary cap portion at an upper aspect thereof. A roof slope adaptor provides continuity between the roof of a building to which the system is affixed and said horizontally oriented capillary cap portion. The upper edge of said roof slope adaptor is placed under shingles at the lower edge of said roof and the lower edge thereof rests atop said horizontally oriented capillary cap portion.

Additional Patents describe the use of slots or openings in gutter shield systems. For instance a Patent to Otto, U.S. Pat. No. 4,866,890 describes "[A] a cover member for mounting on a conventional rain gutter on a building structure, consisting of a one piece thin, longitudinal shield to be inserted under the shingles of the roof and having a serrated outer edge which is bent downward a short distance back from its edge so that it can rest on the flat portion of the inner wall at the top lip of the gutter, the serrations providing small openings which water from the roof can run into the gutter and exclude pine straw or leaves from entering the gutter". Another Patent, U.S. Pat. No. 4,876,827 to Williams describes that "[T] the gutter assembly includes a curved water shed surface with a plurality of openings along its vertical portion which selectively allow the water to enter the gutter positioned below while excluding pine needles, leaves and other debris from engaging the gutter". U.S. Pat. No. 5,181,350 to Meckstroth describes that "[A] an elongated strip of extruded plastics material includes a generally flat longitudinally extending inner portion adapted to project under the shingles of a roof and a longitudinally extending outer portion adapted to seat on the outer edge portion of a rain gutter and project outwardly from the gutter to form a drip lip spaced from the gutter. A longitudinally extending intermediate portion of the strip integrally connects the inner portion to the outer portion and has a rounded nose surface above a U-shaped channel for directing water from the inner portion into the gutter and for deflecting leaves and other debris onto the outer portion of the strip for dropping them from the drip lip". U.S. Pat. No. 4,571,896 to Condie describes that "[A] a gutter assembly is provided which comprises an elongated, preferably transversely flexible sheet which when in an installed position extends along a building roof adjacent an edge of it, while extending below the roof edge. A pipe is provided which has a lengthwise extending slot which accommodates a side edge of the sheet through it adjacent an edge of the slot, while leaving room for entry of only water through the slot". "Such a gutter assembly inhibits entry of foreign matter into the pipe". A similar pipe arrangement is described in U.S. Pat. No. 4,551,956 to Axford. A Patent to Kuhns, U.S. Pat. No. 5,216,851 describes a system with an extended flat portion which does not contain any apertures and serves to close the open top of a gutter to which it is applied. The extended flat portion is connected to an apertured portion, which apertured portion connects to the upper lip of the front wall of a gutter via a lip portion thereof. Said aperatures are shaped to direct water into the associated gutter while causing debris to simply flow over the outer front wall of the gutter. A Patent to Olsen, U.S. Pat. No. 4,631,875 describes a system with a generally planar surface which has a plurality of spaced parallel apertures which allow the entry of water into an underlying gutter. Patents to Way Sr. et al, U.S. Pat. No. 4,937,986 and to Pond, U.S. Pat. No. 2,847,949 describe gutter protection systems which provide an element which projects at a slope opposite to that of a roof to which the gutter they protect is attached, so that water exiting thereonto is slowed thereby. Both provide perforations in the oppositely sloped element so that water can enter to an underlying gutter.

The above survey of Patents shows that numerous systems for preventing clogging of gutter systems have been invented and Patented. Users of many of said systems, however, have found that there remains need for improvement, particularly as regards ease of system installation and effective operation. The present invention provides a system which demonstrates improvement over the known identified existing art.

DISCLOSURE OF THE INVENTION

The present invention is a gutter protection system for use with gutter systems present at lower extents of sloped building roofs. The present system is easy to install and provides utility not present in known systems.

As described in the Background Section, numerous gutter protection systems intended to allow water flowing off a sloped roof to enter an associated gutter, while preventing debris, such as leaves and twigs etc. from entering and causing clogging etc., have been provided by inventors. Said systems provide varying degrees of success in use, and, it is noted, some are quite difficult to install.

Inspection of the systems described in various identified Patents shows that the novelty in said systems is found primarily in their physical shape, and how said physical shape allows utilization of water and debris handling effects. One major such effect utilized is that of capillary action, (e.g. water flowing over the surface of a system element will follow the along the surface of an element, including bends in the surface). Utilization of this effect allows directing water flow into a gutter by capillary action directed flow, while causing debris to be directed otherwise. The presence of holes in system elements can also be used to effect water flow into a gutter system underlying said holes.

Before presenting the present invention system, it must be understood that while capillary action causes water flowing under the influence of gravity to follow the surface of a system element over which it flows, including bends therein, there are, limits involved, (e.g. degrees of bends etc). In general, however, it is to be understood that the slower the rate of water flow over the surface of a system element, the greater can be the angle of a bend present in said surface, without the flowing water "breaking away" from said surface rather than following therealong. System elements which serve to slow the flow rate of water then, can be expected to provide improved system operation, unless said elements also serve to disrupt the water-surface capillary force effected contact. Also, generally, the closer to horizontal a system element can be configured, the slower will be the flow rate of water flowing thereover, and, of course, the greater will be the effect of capillary action. Hence, appropriate water flow rate slowing elements, and approximately horizontally oriented element surfaces, over which water flows during use, are desirable in a gutter protection system. (Note that for debris handling some system element surfaces might preferably be oriented with a slight downward slope, (e.g. fifteen degrees or so), to aid the sweeping away of debris atop thereof, hence, a tradeoff situation can exist. Thus, an optimum gutter protection system should provide for easy field effected adjustment of the angle at which the upper surfaces of major elements are oriented when installed with an associated gutter).

It must also be appreciated that any installation requirements beyond simply securing an edge of a gutter protection system under the last row of shingles on the lower edge of a sloping roof, and affixing a distal edge of a gutter protection system to the forward upper edge of a gutter, are undesirable. As well, it must be understood that gutter protection systems typically come in lengths of a few feet, hence, a plurality of sections must be combined to protect the entire length of a gutter. Any action other than a "sliding" together of adjoining ends of sections again, is undesirable.

From the above it can be concluded that a gutter protection system which has provision for slowing water, including providing as close as possible to a horizontally oriented system element surface area, and which allows installation by simultaneous placement of one edge thereof under the last row of shingles on a building sloped roof while affixing a distal edge thereof to the forward upper edge of a gutter, and which allow sliding together of the ends of adjacent system sections, would be of utility. The present invention teaches a gutter protection system with said attributes.

The present invention system primarily comprises a primary body element, made of a construction material, (e.g. for instance, but not limited to, aluminum), which primary body element incorporates bends therein to provide a distinct, unique functionally oriented, shape, as viewed in side elevation. The present invention system can also comprise essentially "S" shaped mounting brackets for use in affixing the primary body element to the front upper edge of a gutter system, end caps for use at the end of a gutter protection system, and diverter elements for use at converging sloped roof locations.

The best way to describe the primary element is to envision it in side elevation, (the right side is arbitrarily chosen here), oriented properly for installation to a sloping building roof and gutter system at the lower edge thereof, and simply step through the various bends from one edge thereof to the distal edge thereof. Beginning at the edge of the present invention primary body element which, in use, mounts under the first row of shingles of a sloped roof, there is an upward and to the left projecting first length, (e.g. one-eighth inch), of construction material, said first length of construction material merging into an approximately ninety degree bend, said approximately ninety degree bend merging into a second length of construction material which, as viewed, projects upward and to the right for a short distance, (e.g. three-eighths inch). Said second length of construction material merges into a tight one-hundred-eighty degree bend, which tight one-hundred-eighty degree bend merges into a third length of construction material which projects downward and to the left for a distance, (e.g. three to four inches), then, in a preferred embodiment, merges into an approximately forty-five degree bend, said approximately forty-five degree bend merging into a forth length of construction material, which forth length of construction material projects, (e.g. one-eighth inch) downward and to the right and then merges into an approximately ninety degree bend, said approximately ninety degree bend merging into a fifth length of construction material, which fifth length of construction material, (e.g. one-half inch), projects upward and to the right and merges into gradual approximately one-hundred-eighty degree bend, which gradual approximately one-hundred-eighty degree bend merges into sixth length of construction material which projects, (e.g. one-half inch), downward and to the left. (Note some embodiments provide a tight one-hundred-eighty degree bend between the third and forth lengths of construction material and merge the forth and fifth lengths of construction material, with said approximately ninety degree bend therebetween being eliminated. Other flow reversal effecting geometries are also possible as demonstrated in the Drawings of this Disclosure). Said sixth length of construction material merges into a gradual approximately forty-five degree bend, said gradual approximately forty-five degree bend merging into a seventh length of construction material, which seventh length of construction material projects essentially horizontally to the left (e.g. three to four inches), and merges into a gradual approximately forty-five degree bend. Said gradual approximately forty-five degree bend merges into an eighth length of construction material, which eighth length of construction material projects (e.g. one-half-inch), downward and to the right, and merges into an approximately ninety degree bend, said approximately ninety degree bend merging into a ninth length of construction material which projects, (e.g. one-quarter inch), downward and to the left and merges into an approximately forty-five degree bend. Said ninth length of construction material has holes present therein through which water can flow and enter a gutter system positioned therebelow, and said eighth length of construction material can have patterns punched thereinto which serve to guide water flowing thereover toward said holes in said ninth length of construction material. Said approximately forty-five degree bend into which the ninth length of construction material merges, merges into a tenth length of construction material, said tenth length of construction projects (e.g. three-eighths inch), upward and to the left and merges into an approximately ninety degree bend, said approximately ninety degree bend merging into an eleventh length of construction material, which eleventh length of construction material projects, (e.g. three-eighths inch), downward and to the left and merges into a gradual approximately fifteen degree bend, said gradual approximately fifteen degree bend merges into a twelfth length of construction material. Said twelfth length of construction material projects, (e.g. one-half inch), downward and to the right and merges into a gradual approximately forty-five degree bend. Said gradual approximately forty-five degree bend merges into a thirteenth length of construction in a gradual "U" shape which projects, (e.g. one-quarter inch), downward and to the left. Said "U" shape opens to the left and downward. In some embodiments the thirteenth length of construction material is extended, (e.g. an additional one-quarter inch), at certain regions along a longitudinal length of a primary body element, which extended thirteenth lengths of construction material regions each merge into an approximately forty-five degree angle, said approximately forty-five degree angles merging into fourteenth lengths of construction material which project, (e.g. one-quarter inch), essentially upward. In other embodiments one end of "S" or "Z" shaped clips are slid into the area defined by the tenth, eleventh and twelfth lengths of construction material, and the other end thereof provides an equivalent to said extensions of said thirteenth length of construction material and said fourteenth lengths of construction material. Said fourteenth lengths of construction material or said "S" or "Z" shaped clips comprise mounting means for gripping a gutter lip when installed with an associated gutter.

Note that the lengths and angles provided in the foregoing are generally exemplary and not limiting. That is, the lengths and angles provided can vary within a range of at least plus or minus twenty (20%) percent, and the angles associated with the third, forth, fifth and sixth lengths of construction material will be varied at installation, as described directly.

It will be appreciated that, during use, the primary body element third length of construction material can be easily oriented at a desired angle with respect to the seventh length of construction material by a simple bending action about the locus of the merger between the fifth and sixth lengths of construction material. Said bending can be easily effected by a user with his or her bare hands, by grasping the third and seventh lengths of construction material in right and left hands and applying reasonable relative rotational force. This allows easy customizing of the primary body element for the fitting thereof to specific sloped roof-gutter combinations such that the seventh length of construction material is oriented essentially horizontally, or with a slight downward angle, above a gutter to which it is affixed, and the third length of construction material is angled to essentially match the slope of the adjacent sloped roof. As mentioned above, an essentially horizontally oriented system element surface is effective in slowing flowing water. It is noted, however, that a primary body element mounted above an associated gutter with a seventh length of construction material angled slightly downward, can aid with directing debris off thereof in use. The ease of configuration by a user, as described, allows the effecting of an optimum mounting angle between the third and seventh lengths of construction material. Other aspects of the primary body element are essentially rigid and can not be easily reconfigured without express use of tools. Again, bending is easily effected along the locus of the merger between the fifth and sixth lengths of construction material.

Continuing, it is to be especially understood that the angled configuration associated with the forth, fifth and sixth lengths of construction material, which forth, fifth and sixth lengths of construction material effect continuity between the third and seventh lengths of construction material, serves to provide, at the gradual one-hundred-eighty degree bend between the fifth and sixth lengths of construction material described above, a means at which the flow of water down the third length of construction material during use off of a slope roof, under the influence of capillary action, is slowed down. The combination of the forth, fifth and sixth lengths of construction material constitute a "water flow slowing means". Alternative embodiments of the "water slowing means" are possible, but all have the common functional purpose of causing water flowing thereinto off of the third length of construction material to reverse direction of flow twice before flowing onto the surface of the seventh length of construction material. That is, assuming that water flow does not evade control by capillary action, it will typically have to reverse flow direction as it follows the path from the third to the forth and fifth lengths of construction material, and again reverse flow direction as it follows the path from the fifth to the sixth lengths of construction material. It is possible that water flowing as over the water flow slowing means as described above will follow the gradual approximately one-hundred-eighty angle between the fifth and sixth lengths of construction material and flow on to the seventh length of construction material under the control of capillary action, or it might, after reversing direction once, drip onto the seventh length of construction material from the fifth length of construction material. In any event, the flow of the water will be slowed by the turbulence creating effect caused by the presence of said "water flow slowing means".

Note that it is also possible to provide a plurality of such "water flow slowing means" present between the lengths of construction material identified as third and seventh above. That is a plurality of forth, fifth and sixth lengths of construction material merged by angles as described above could be present. Identification of said additional lengths of construction material would be as first, second and third etc., forth prime, fifth prime and sixth prime lengths of construction material, so that the seventh length of construction material and lengths of construction thereafter retain their same identification.

It is pointed out that the merger of the seventh and eighth lengths of construction material preferably is located over and to the left of the merger of the tenth and eleventh lengths of construction material. This arrangement serves to further prevent debris entry into the region of the holes in the ninth length of construction material.

Continuing, the system of the present invention also comprises end caps cut to shape for application to the ends of the primary body element as described above. Said end caps will be better understood by reference to the Drawings.

It should also be understood that the first length of construction material and the approximately ninety degree bend into which it merges serve to provide laterally directed rigidity to a length of the present invention primary body element. In addition, in use, said first length of construction material serves to grip the surface of a roof, under the first row of shingles, which it contacts. Combined with the downward force applied by the first row of shingles, the need for nails etc. to hold the present invention system in place, is avoided.

In use water flowing off a roof onto the primary body element of the present invention enters an underlying gutter system through the holes in the ninth length of construction material, with any debris present being flushed onto and over the eleventh length of construction material, then over the upper front lip of said underlying gutter system, and drops thereoff.

Note that when the primary body element of the present invention is installed with an associated gutter system, the upper front lip of said associated gutter system is the foremost projecting element of the combination. That is, should, for instance, a ladder be leaned against the combination, it makes contact with the gutter system, and not the primary body element The system of the present invention design also allows easy installation because ends of segments of primary body elements are such that they can slide into one another. That is, no screws or brackets etc. are required to effect secure interconnection.

The present invention will be better understood by reference to the Detailed Description Section of this Disclosure with reference being had to the accompanying Drawings.

SUMMARY OF THE INVENTION

The use of gutters as a means to direct water flowing off a sloped roof to downspouts is well known. Also well known are the problems associated with gutter clogging when leaves and twigs etc. accumulate in gutters.

Numerous inventors have provided gutter protection systems which are meant to allow water to flow into gutters, but direct leaves and twigs etc. elsewhere. Problems, however, remain in that the instalation of some such systems can be difficult. As well, various of said systems provide less than optimum success in achieving intended results during use.

It is therefore a purpose of the present invention to provide a gutter protection system which is easy to install.

It is another purpose of the present invention to provide a gutter protection system which operates very well during use.

DETAILED DESCRIPTION

Figure 1:
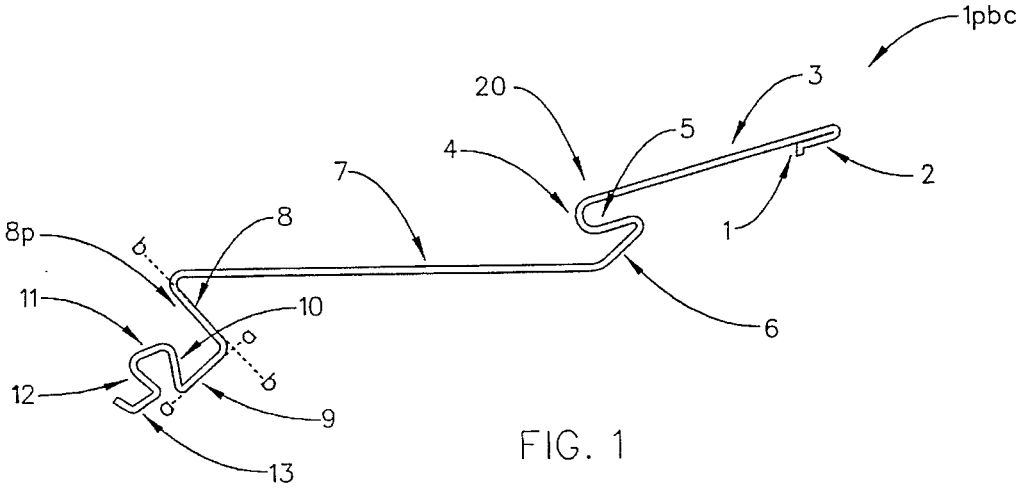
FIG. 1 shows a right side elevational view of the primary body element of the present invention gutter protection system.
Figure 2:
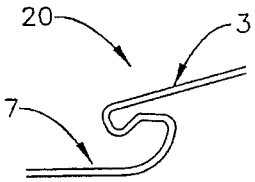
FIG. 2 shows that the primary body element of FIG. 1 can be easily bent around a water flow slowing means therein.
Figure 3A:
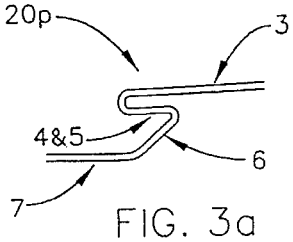
FIGS. 3*a* and 3*b* show alternative water flow slowing means.
Figure 3B:
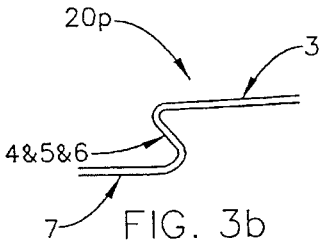
Figure 6:
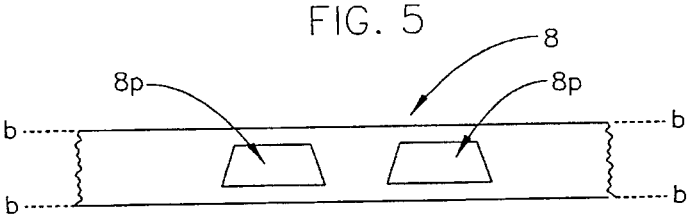
FIG. 6 shows a cross sectional view taken at b—b in FIG. 1
Figure 7:
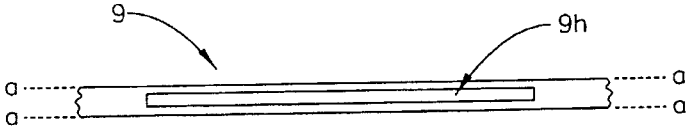
FIG. 7 shows a cross sectional view taken at a—a in FIG. 1.
Figure 12:
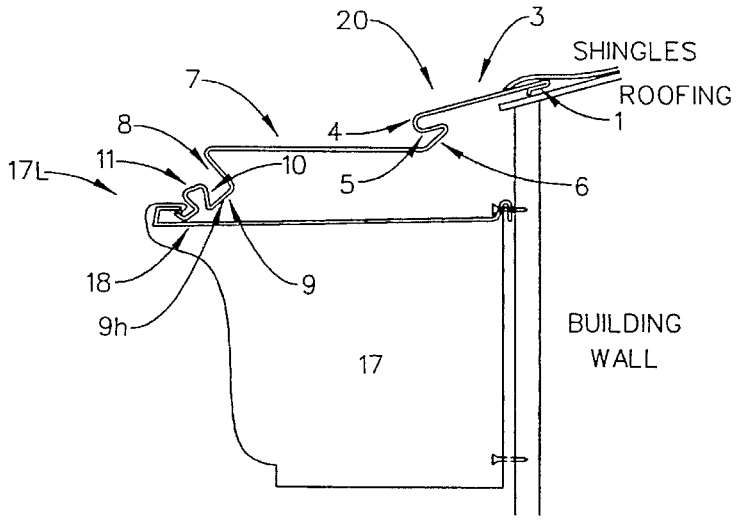
FIG. 12 shows the primary body element of FIG. 1 mounted to a gutter system mounted to the side of a building which has a sloped roof.

Turning now to the Drawings, there is shown in FIG. 1 a right side elevational view of the primary body element (1*pbe*) of the present invention after fabrication and before installation to a gutter system at the lower edge of a building sloped roof. Beginning at the right side of said drawing, there is shown a vertically projecting first length of construction material (1) which merges into a second length of construction material (2) which projects to the right, said merging being by way of an approximately ninety-degree bend. A tight one-hundred-eighty-degree bend follows such that said second length of construction material (2) merges into a third length of construction material (3) which projects to the left. Said third length of construction material (3) merges into a "water flow slowing means" (20). In FIG. 1 said water flow slowing means comprising a forth length of construction material (4) which projects downward and to the right, a fifth length of construction material (5) which projects upward and to the right, and a sixth length of construction material (6) which projects downward and to the left. FIGS. 3*a* and 3*b* show alternative embodiments of said water flow slowing means (20) in which the forth and fifth and sixth lengths of construction material (4), (5) & (6) are variously merged into composite elements. The water flow slowing means (20) of FIG. 1 can be described as a "V" followed by an Inverted "V" in shape. It is to be understood that an option provides that the inverted "V" shape be preceeded by a horizontally projecting length of construction material. This is shown in FIG. 2. In this case, it is to be understood, the inverted "V" shape opens downward and to the left rather than simply downward. FIG. 3*b* shows a water flow slowing means (20*p*) which can be described as an "S" shape and FIG. 3*a* shows a water flow slowing means (20*p*) which can be described as an "S" shape with the upper portion collapsed. In the embodiment of FIG. 3*b* the forth and sixth lengths of construction material can be considered to be arcuate shaped, with the fifth length of construction material essentially straight therebetween. In the embodiment of FIG. 3*a* the forth and fifth lengths of construction material can be considered to be adjacent and in line with one another, while the sixth length of construction material projects downward and to the left. It is to be understood that the purpose of said water flow slowing means, (20) or any variation (20*p*), is to slow the flow of water which, by capillary action, essentially follows the surface of said forth, fifth and sixth lengths of construction material (4), (5) & (6) by through a flow direction reversals. A few preferred embodiments of the water flow slowing means are presented, but it is to be understood that any water flow direction reversing functionally similar configuration is to be considered equivalent for the purposes of the claims to the present invention. Continuing, the sixth length of construction material merges into a seventh length of construction material (7) via a bend such that said seventh length of construction material projects to the left essentially horizontally, but can have a small slope of up to approximately fifteen degrees. Said seventh length of construction material (7) merges into a downward and to the right projecting eighth length of construction material (8) via a bend. Note that said eighth length of construction material (8) can have punched projections (8*p*) present thereon, as better shown in FIG. 6. Note that FIG. 6 is a cross section taken at b—b in FIG. 1. Optionally, said seventh length of construction material (7) can also have similar such punched projections present for the same purpose. Continuing, said eighth length of construction material (8) merges into a downward and to the left projecting ninth length of construction material (9). Note that said ninth length of construction material (9) has holes (9*h*) present. FIG. 7 provides a better view of said holes (9*h*). Note that FIG. 7 is a cross section taken at a—a in FIG. 1. During use, water flowing over the eighth length of construction material (8) under the influence of gravity and capillary action flows into holes (9*h*) in the ninth length of construction material (9), perhaps guided by punched projections (8*p*) in the eighth length of construction material (8), and in the seventh length of construction material (7), if present. FIG. 12, which shows the primary body element (1*pbe*) of the present invention, makes clear that water entering holes (9*h*) will flow into an associated gutter system (17). Continuing, said ninth length of construction material (9) merges into an upward and to the right projection tenth length of construction material (10). Said tenth length of construction material (10) merges into a downward and to the left projecting eleventh length of construction material (11), and said eleventh length of construction material (11) merges into a downward and to the right projecting twelfth length of construction material (12). Said twelfth length of construction material (12) merges into a downward and to the left projecting thirteenth length of construction material (13) in a gradual "U" shape. The "U" shape opens to the left and downward. It is to be noted that the locus of the merger of the seventh (7) and eighth (8) lengths of construction material projects to the left further than does the locus of the merger of the tenth (10) and eleventh (11) lengths of construction material, such that the locus of the merger of the tenth (10) and eleventh (11) lengths of construction material is under the seventh (7) and eighth (8) lengths of construction material. This serves to guide debris flowing over the seventh (7) length of construction material away from the holes in the ninth (9) length of construction material in use.

Figure 4:
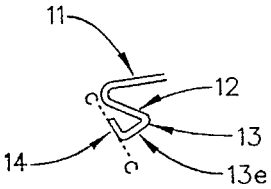
FIG. 4 shows an extention of the primary body element of FIG. 1.
Figure 5:
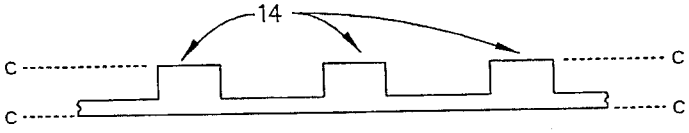
FIG. 5 shows a cross sectional view taken at c—c in FIG. 4.
Figure 8:
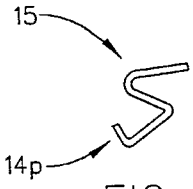
FIG. 8 shows a right side elevational view of a mounting clip for use with the primarily body element of FIG. 1.
Figure 9:
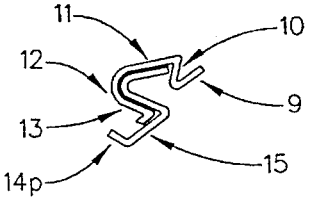
FIG. 9 shows the mounting clip of FIG. 8 mounted in the primary body element of FIG. 1.

FIGS. 4 and 5 show that in some embodiments fourteenth lengths of construction material (14) can merge from said thirteenth length of construction material (13). Note that FIG. 5 is a cross section taken at c—c in FIG. 4. FIG. 8 shows that in some embodiments mounting clips (15) can be present to provide an equivalent to the fourteenth lengths of construction material (14), said equivalents being identified as (14*p*). FIG. 9 shows that said mounting clips (15) fit into the portion of the present invention primary body element (1*pbe*) formed by the tenth, eleventh, twelfth and thirteenth (10), (11), (12), & (13) lengths of construction material.

Continuing, reference to FIG. 2 shows that the primary body element of FIG. 1 can be configured with the third and seventh lengths of construction material (3) & (7) at an angle to one another. Reference to FIG. 12 shows that this is necessary when mounting the primary body element to a building roof and gutter (17) combination system. It is to be understood that while the present invention primary body element (1*pbe*) is rigid in the longitudinal direction, (i.e. the approximately ninety-degree bend between the first and second lengths of construction material (1) & (2) provides said rigidity), it is easily bent about the water flow slowing means (20). This attribute greatly simplifies installation. Also note in FIG. 12 that when installed the first length of construction material (1) engages the roof under the first row of shingles. Note that the downward force of the shingles applied to the upper surface of the third length of construction material (3) serves to cause the first length of construction material to grip said roof, thereby negating the need for other securing means, such as nails etc. Also note in FIG. 10 that the fourteenth lengths of construction material (1), (or equivalents provided by mounting clips as shown in FIGS. 8 and 9), serve to simultaneously grip the upper front lip (171) of gutter (17). Installation of the primary body element as shown in FIG. 12 then consists of pushing the first, second and third lengths of construction material (1), (2) & (3) under the first row of shingles on a roof, and simultaneously causing the fourteenth length of construction material (14), (or equivalent (14p where mounting clips are used), extend under the upper front lip (17*l*) of a gutter (17). This has proven to be a very easy task to accomplish in practice. Also note that a primary body element (1*pbe*) of the present invention will typically be on the order of three feet long. Thus, a plurality of said primary body elements (1*pbe*) will necessarily have to be mounted longitudinally with respect to one another to cover the entire length of a gutter system. The primary body element (1*pbe*) are thus fabricated to allow easy adjoining abutment, either by use of coupling elements, or by simply sliding the end of one primary body element length into the end of another. It should be noted that when the primary body element of the gutter protection system is installed as shown in FIG. 10, the first length of construction material (1) projects upward and to the left, the second length of construction material (2) projects upward and to the right and the third length of construction material (3) projects downward and to the left.

Figure 10:
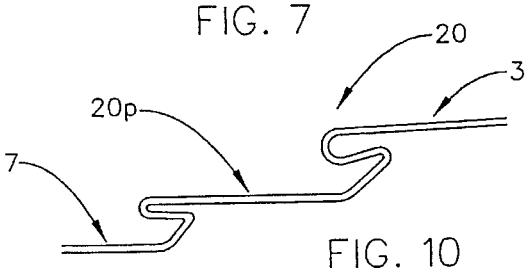
FIG. 10 shows a portion of the primary body element of FIG. 1 with two water flow slowing means present.

Turning now to FIG. 10, note that a plurality of water flow slowing means (20) & (20*p*) for instance, can be present between the first and seventh lengths of construction material (1) & (7) to better slow water traveling therethrough during use. In FIG. 10 there are shown two water flow slowing means of different embodiments (20) & (20*p*), but it is to be understood that a plurality of similar embodiments can also be used as can be alternative water flow reversal geometry water flow slowing means, such as that shown in FIG. 3*b*.

Figure 13:
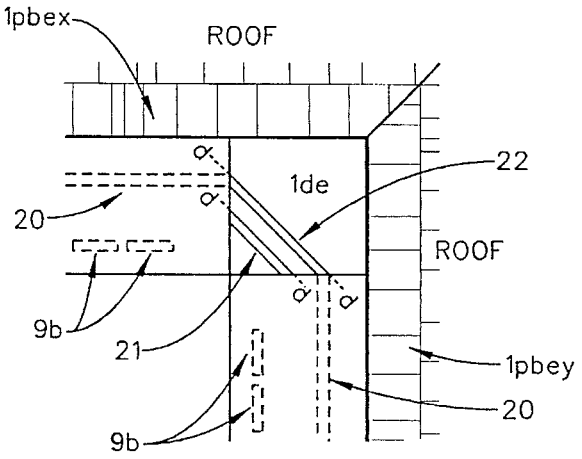
FIG. 13 shows a diverter system for use in the present invention gutter protection system at merging roof locations.
Figure 14:
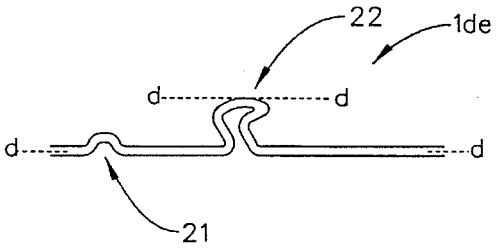
FIG. 14 shows a cross sectional view taken at d—d in FIG. 13.

Turning now to FIG. 13, there is shown a diverter element (1*de*) of the present invention for application at converging roof locations. Shown are roof section at the upper and right in FIG. 13, to each of which is attached a primary body element, (e.g. (1*pbex*) and (1*pbey*). In the essentially square area between the two primary body elements (1*pbex*) & (1*pbey*), there is shown present said diverter element (1*de*). FIG. 14 shows a cross sectional view taken along d—d in FIG. 13. Note that the water directing means (22) is oriented catercorner and will serve, during use, to direct water toward the primary body element (1*pbex*) & (1*pbey*), ahead of water flow slowing means (20) in each thereof. An additional water directing element (21) is also shown present on diverter element (1*de*). Water running of diverter element (1*de*) will be encouraged to flow toward and through previously described holes (9*h*) in said primary body elements (1*pbex*) a (1*pbey*).

It is to be noted that, as shown and viewed in FIG. 12, the rightmost extent of the primary body element (1*pbe*), when mounted to a gutter system (17), does not project past the rightmost front upper lip (17L) of said gutter system (17). As a result, a ladder will contact the rightmost upper front lip (17L) of the gutter system (17) when leaned against the combination gutter system (17) rather than an installed primary body element (1*pbe*). Note that "d" shows where a bend is made in end cap (1*ec*) so that a match with the seventh length of construction material is effected.

In use debris accompanying water flow over the primary body element (1*pbe*) will not enter holes (9*h*), but will exit the seventh length of construction material (7), and be guided by the upper surface of the eleventh length of construction material (11) to the rightmost upper lip (17L) of the gutter system, (as viewed in FIG. 12), from which it will fall. Simultaneously, water will be directed into underlying gutter system (17) through holes (9*h*) in the ninth length of construction material.

Figure 11:
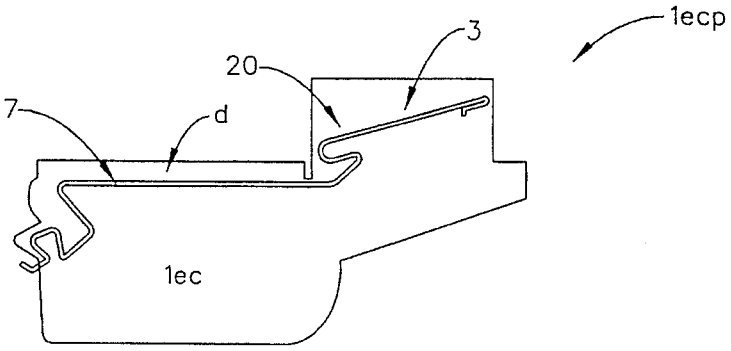
FIG. 11 show an end cap for use with the primary body element of FIG. 1, with the primary body element of FIG. 1 shown in broken hidden lines.

FIG. 11 is included to show an end cap element (1*ec*) for use at the last of a run of primary body elements (1*pbe*), which end is also shown in broken hidden lines. In particular note that the end cap (1*ec*) provides an end cap flap (1*ecf*) which can be easily customized to fit a specific instalation. Lines "a", "b" and "c" in end cap element flap (1*ecf*) show possible bend points which can be identified during installation so that the end cap (1*ec*) will match as built installation procedure effected angle between the third and seventh lengths of construction material (3) & (7), (i.e. that angle required to match the third length of construction material (3) to the slope of the roof while the surface of the seventh length of construction material (7) is oriented essentially horizontally or with slight downward slope.

It is specifically noted that the water flow slowing means (20), (20*p*) etc., in primary body element (1*pbe*), which during use effects, via capillary action, water flow direction reversals as described above, is considered a particularly important aspect of the present invention.

It is also specifically stated that the installation method comprises:

1. providing a primary body element (1*pbe*);

2. bending the primary body element about the water flow slowing means (20), (20*p*) etc. so that the third length of construction material (3) can be matched to the slope of a roof while the surface of the seventh (7) length of construction material is oriented essentially horizontally or with a slight downward slope. Note that Bending easily occurs primarily at the locus of the merger between the fifth (5) and sixth (6) lengths of construction material;

3. sliding the end of the primary body element (1*pbe*) at which are located first, second and third lengths of construction material (1), (2) & (3) under the first row of shingles present on a roof;

4. simultaneously causing the fourteenth lengths of construction material (14), or mounting clip provided equivalents (14*p*), to grip the front upper lip (17L) of gutter system (17) with lip of the front upper lip of the gutter positioned within the "U" shape merger of the twelfth (12) and thirteenth (13) lengths of construction material.

In addition, optional steps include sliding ends of lengths of adjacent primary body elements into one another, (note coupling elements can be used in the alternative), applying end caps (1*e*) and diverter elements (1*de*). Application of end caps (1*ec*) require that an end cap be positioned against the end of a primary body element (1*pbe*), to determine where the end cap flap (1*ecf*) should be bent so as to match the locus defined by the third length of construction material, then bending said end cap flap (1*ecf*), then forcing said bent portion of said end cap flap between the second and third lengths of construction material (2) & (3) to secure it in place.

Having hereby disclosed the subject matter of the present invention, it should be obvious that many modifications, substitutions and variations of the present invention are possible in light of the teachings. It is therefore to be understood that the invention can be practiced other than as specifically described, and should be limited in breadth and scope only by the claims.

I claim:

1. A gutter protection system which serves to direct rain water into an underlying gutter system to which it is affixed while preventing the entry of debris into said underlying gutter system, said underlying gutter system being affixed to a lower edge of a sloped building roof and being oriented so as to assume a generally vertically downward slope between said downward sloped building roof and a point of attachment of said gutter protection system to said underlying gutter system, said gutter protection system comprising: a primary body element in which is present a water flow slowing means which serves to essentially reverse the direction of flow of rain water at least twice between the entry of said rain water onto an upper surface of said gutter protection system, and the flow of said rain water into said underlying gutter system, which gutter protection system utilizes capillary action to direct said rain water flow through said water flow slowing means during use, said capillary action being unevaded through at least said first of said at least two flow direction reversals, said gutter protection system providing, via unevaded capillary action, said rain water exiting said first of said at least two flow direction reversals in said water flow slowing means at a vertically lower position than that at which said rain water entered said water flow slowing means.

2. A gutter protection system as in claim 1 in which the water flow slowing means comprises an "S" shape.

3. A gutter protection system as in claim 1 in which the water flow slowing means comprises an "S" shape with the upper portion thereof collapsed.

4. A gutter protection system as in claim 1 in which the water flow slowing means comprises a "V" shape followed by an inverted "V" shape.

5. A gutter protection system primary body element as in claim 1, in which the water flow slowing means comprises second, third and forth lengths of construction material, which gutter protection system further comprises, in combination with said water flow slowing means, first and fifth lengths of construction material; said first length of construction material, as viewed in right side elevation, being projected downward and left and being merged into said second length of construction material, said second length of construction material being projected downward and right and being merged into said third length of construction material, said third length of construction material being projected upward and right and being merged into said forth length of construction material, said forth length of construction material being projected downward and left being merged into said fifth length of construction material and said fifth length of construction being projected essentially horizontally; a locus of merger between said third and forth lengths of construction material allowing easy bending therearound such that the angle between the first and fifth lengths of construction materials can easily be set to that required to match the slope of said sloped building roof.

6. A gutter protection system primary body element as in claim 5, in which an end of one length of primary body element is slid into an adjacent end of another length of primary body element such that adjacent ends of lengths of said water flow slowing means second, third and forth lengths of construction material make secure overlapping contact with one another.

7. A gutter protection system comprising a primary body element which when configured for installation above a gutter system affixed to a lower edge of a sloped building roof, and viewed in right side elevation, comprises:

an upward and left projecting roof gripping first length of construction material, said first length of construction material being merged into an upward and right projecting second length of construction material, said second length of construction material being merged into a downward and left projecting third length of construction material via a tight one-hundred-eighty degree bend, said third length of construction material being merged into a water flow slowing means comprising water flow direction reversal effecting forth, fifth and sixth lengths of construction material, said sixth length of construction material being merged into an essentially horizontally left projecting seventh length of construction material, said seventh length of construction material being merged into a downward and right projecting eighth length of construction material, said eighth length of construction material being merged into a downward and right projecting ninth length of construction material, said ninth length of construction material having therein holes through which water can enter to an underlying gutter system to which the gutter protection system is affixed during use, said ninth length of construction material being merged into an upward and left projecting tenth length of construction material, said tenth length of construction material being merged into a downward and left projecting eleventh length of construction material, said eleventh length of construction material being merged into a downward and right projecting twelfth length of construction material, said twelfth length of construction material being merged into a downward and left projecting thirteenth length of construction material, such that during use said gutter protection system is affixed above a gutter system which is mounted at a lower edge of a sloped building roof with said first length of construction material set atop said roof and held in place by downward pressure from a first row of shingles located thereabove, which first row of shingles rest atop said third length of construction material, and such that said thirteenth length of construction material is secured adjacent to a front upper lip of said gutter system, such that rain water flowing from said sloped roof flows onto the upper surface of said third length of construction material, and is slowed by at least two direction of flow reversals as said rain water transverses said water flow slowing means under the influence of capillary action, then enters said underlying gutter system via said holes in said ninth length of construction material, while debris accompanying said rain water, is caused to proceed past the surface of the eleventh length of construction material and off of said gutter protection system primary body element as well as past said front upper lip of said gutter and exit other than into said gutter system.

8. A gutter protection system primary body element as in claim 7 in which said third length of construction material merges into the forth length of construction material, said forth length of construction material being projected downward and right, said forth length of construction material being merged into the fifth length of construction material, said fifth length of construction material being projected upward and right, said fifth length of construction material being merged into said sixth length of construction material, said sixth length of construction material being projected downward and left, said forth, fifth and sixth lengths of construction serving to form a "V" followed by an inverted "V" shape.

9. A gutter protection system primary body element as in claim 7 in which the forth, fifth and sixth lengths of construction material form an "S" shape, in which the forth and sixth lengths of construction material are arcuate shaped, and the fifth length of construction material is essentially straight thereinbetween.

10. A gutter protection system primary body element as in claim 7 in which the forth, fifth and sixth lengths of construction material form an "S" shape, in which the upper portion thereof is collapsed such that the forth and fifth lengths of construction material project in line essentially horizontally and to the right and such that the sixth length of construction material projects downward and left.

11. A gutter protection system primary body element as in claim 7 in which the forth length of construction material is "V" shaped, the fifth length of construction is of an inverted "V" shape opening downward and left, and the sixth length of construction material projects downward and left.

12. A gutter protection system primary body element as in claim 7 which further comprises a plurality of fourteenth lengths of construction material positioned longitudinally along a length thereof, each of said fourteenth lengths of construction material being projected essentially vertically, with said thirteenth length of construction material merging into each of said fourteenth lengths of construction material.

13. A gutter protection system primary body element as in claim 12 in which the various lengths of construction material are approximately:

first—one-sixteenth inch;

second—three-eighths inch;

third—three-and-seven-eighths inches;

forth—one-eighth inch;

fifth—one-eighth inch;

sixth—one-half inch;

seventh-three-and-one-half inches;

eighth—one-half inch;

ninth—one-quarter inch;

tenth—three-eighths inch;

eleventh—three-eighths inch;

twelfth—one-half inch;

thirteenth—three-eighths inch;

fourteenth—one-quarter inch, and in which the angles between merging lengths of construction material are approximately as follows:

ninety degrees between the first and second lengths of construction material;

one-hundred-eighty degrees between the second and third lengths of construction material;

forty-five degrees between the seventh and eighth lengths of construction material;

ninety degrees between the eighth and ninth lengths of construction material;

forty-five degrees between the ninth and tenth lengths of construction material;

ninety degrees between the tenth and eleventh lengths of construction material;

fifteen degrees between the eleventh and twelfth lengths of construction material;

forty-five degrees between the twelfth and thirteenth lengths of construction material; and forty-five degrees between thirteenth and fourteenth lengths of construction material.

14. A gutter protection system primary body element as in claim 7 which further comprises essentially "S" shaped mounting brackets, an upper end of said essentially "S" shaped mounting brackets being mounted in the region defined by the tenth, eleventh and twelfth lengths of construction material, such that a lower end of said essentially "S" shaped mounting bracket provides an essentially vertically projecting element which grips the front upper lip of said gutter system.

15. A gutter protection system primary body element as in claim 7 which further comprises punched projections in either of said seventh and eighth lengths of construction material which serve to direct water flowing thereover toward said holes in said ninth length of construction material.

16. A gutter protection system primary body element as in claim 7 which further comprises more than one water flow slowing means prior to the eighth length of construction material.

17. A gutter protection system as in claim 7 which further comprises end caps which serve to cover the ends of said gutter protection system and are secured thereto by insertion of a flap thereof between said second and third lengths of construction material at said tight one-hundred-eighty degree bend.

18. A gutter protection system as in claim 7 which further comprises a diverter element for use at converging roof locations, said diverter element comprising water directing means for directing a flow of water thereonto during use, to two gutter protection system primary body elements each of which attaches to said diverter element at a ninety degree angle with respect to the other, each of said primary body elements being mounted atop a gutter system along the lower edge of a building sloped roof, said water directing means on said diverter element being a projection from said diverter element oriented catercorner so as to provide water essentially equally to both said gutter protection systems, at a location thereon ahead of the water flow slowing means on each primary body element.

19. A gutter protection system primary body element as in claim 7 in which the term "essentially horizontally" as applied to said seventh length of construction material is interpreted broadly so as to include a small slope of up to fifteen degrees.

20. A gutter protection system primary body element as in claim 7 in which the locus of merger between the fifth and sixth lengths of construction material allow easy bending therearound such that the angle between the third and seventh lengths of construction materials can be set to that required to match the slope of said sloped roof.

21. A gutter protection system primary body element as in claim 7 in which the merger of the tenth and eleventh lengths of construction material is present beneath the seventh and eighth lengths of construction material, with the merger of the seventh and eighth lengths of construction material being located to the left of said merger of said tenth and eleventh lengths of construction material, such that in use debris passing over the seventh length of construction material is prevented from entering the holes in the eighth length of construction material.

22. A gutter protection system primary body element as in claim 7 in which the twelfth length of construction material merges into the thirteenth length of construction material in a gradual "U" shape which opens to the left and downward, said gradual "U" shape serving to allow easy mounting to the lip of a gutter in use.

* * * * *